US007223123B2

(12) United States Patent
Brooks

(10) Patent No.: US 7,223,123 B2
(45) Date of Patent: May 29, 2007

(54) DESK AND DESKING SYSTEM

(75) Inventor: Steven Brooks, Frimley Green (GB)

(73) Assignee: Intercase UK Limited, Finchampstead (GB)

( * ) Notice: Subject to any disclaimer, the term of this patent is extended or adjusted under 35 U.S.C. 154(b) by 0 days.

(21) Appl. No.: 10/628,836

(22) Filed: Jul. 28, 2003

(65) Prior Publication Data

US 2004/0097135 A1 May 20, 2004

Related U.S. Application Data

(63) Continuation of application No. PCT/GB02/00347, filed on Jan. 28, 2002.

(30) Foreign Application Priority Data

Jan. 26, 2001 (GB) ..... 0102143
Aug. 2, 2001 (GB) ..... 0118896

(51) Int. Cl.
*H01R 33/945* (2006.01)

(52) U.S. Cl. ..... 439/577

(58) Field of Classification Search ..... 439/577; 361/683, 681; 312/223.1, 223.6, 196, 195, 312/140.3, 280
See application file for complete search history.

(56) References Cited

U.S. PATENT DOCUMENTS 5,655,822 A 12/1997 Roberts et al.
5,763,985 A * 6/1998 Asinovsky ..... 312/223.2
6,059,385 A * 5/2000 Guhl ..... 312/223.2
6,169,655 B1 1/2001 Helot
6,667,888 B1 * 12/2003 Chang et al. ..... 361/737
2002/0199048 A1 * 12/2002 Rabinovitz ..... 710/100

FOREIGN PATENT DOCUMENTS

| | | |
|---|---|---|
| EP | 0447961 | 9/1991 |
| EP | 1 217 919 | 4/2001 |
| JP | 10211037 | 8/1998 |
| JP | 2000077864 | 12/1999 |
| JP | 2000214955 | 8/2000 |

* cited by examiner

*Primary Examiner*—J. F. Duverne
(74) *Attorney, Agent, or Firm*—Fish & Richardson P.C.

(57) ABSTRACT

A desk is adapted for connection to a second desk as part of a network of desks. The desk includes a desktop, a chassis positioned substantially beneath the desktop and including one or more cassettes, wherein at least one cassette includes one or more electronic components, a power distribution system providing power to at least one cassette and configured to provide power to at least one adjacent desk, and an electronic connection system providing an electronic connection from the one or more electronic components to an electronic component located in an adjacent second desk. The power distribution system and the electronic connection system are positioned substantially beneath the desktop and extend approximately from a first side of the desktop to a second side of the desktop.

34 Claims, 4 Drawing Sheets

DESK AND DESKING SYSTEM

CROSS-REFERENCE TO RELATED APPLICATIONS

This application is a continuation of International Application Number PCT/GB02/00347, filed Jan. 28, 2002, which claims priority from applications filed in the United Kingdom having application numbers 0102143.5, filed Jan. 26, 2001, and 0118896, filed Aug. 2, 2001. This application claims priority from each of the above-referenced applications, each of which is incorporated herein by reference.

BACKGROUND

The present invention relates generally to desks and desking systems.

A conventional desk for supporting a computer includes a main desktop, various drawers and cupboards, and possibly one or more drawers and/or stands for supporting a computer keyboard and/or viewing screen (VDU). Some computer desks also include a drawer, rack or stand for the central processing unit (CPU) chassis, to position the CPU toward the rear of the desk or beside a desk leg, rather than on the desktop or the floor beside or beneath the desk. Typically, a VDU, a mouse, and often the keyboard are positioned on top of the main desktop, and often one or more peripheral devices are also placed on top of the desktop.

In an environment including several computer desks, for example, in an office of networked computers, each desk is typically separate from the others and the power and electronics cabling is supplied to each desk individually from power and cable connection points on the floor or walls. In an education institution, for example, classrooms are set up with one or more rows of desks, each desk carrying one or more respective computers, and desks are often placed side-by-side, or otherwise adjacent one another.

Convention computer desks (or environments including several computer desks, e.g., offices, classrooms) require: (i) power cabling to a computer processor and various computer peripheral devices (e.g., VDU, keyboard, mouse, printer, scanner); (ii) cabling between the processor and peripheral devices, and between various peripheral devices; (iii) a telephone connection for Internet access; and (iv) in some cases, network cabling connecting two or more computers to each other and to other devices. Systems for handling these cables include tying them together with plastic cable ties, string, or plastic "Cable Zip" tubes, taping the cabling to the floor, placing the cabling under rubber cable protectors that form ridges on top of the floor, or placing the cabling in trunking under the floor.

Conventional computer desks are not made to connect to one another. In environments including several computer desks, they are generally simply placed side by side, and can be moved about, or they are tied together using a crude system such as cable ties, which typically still allow some movement. Existing desking systems are not designed to provide a flexible arrangement of desk placement when one or more desks are connected together in some fashion.

SUMMARY

In general, in one aspect, the invention features a desk adapted for connection to a second desk as part of a network of desks. The desk includes a desktop having a plurality of sides, a bottom-face, and a top face; a chassis positioned substantially beneath the desktop including one or more cassettes, wherein at least one cassette includes one or more electronic components; a power distribution system providing power to at least one cassette and configured to provide power to at least one adjacent desk or bridge unit; and an electronic connection system providing an electronic connection from the one or more electronic components to an electronic component located in a second desk. The power distribution system and the electronic connection system are positioned substantially beneath the desktop and extend approximately from a first side of the desktop to a second side of the desktop.

Embodiments of the invention can include one or more of the following. The power distribution system and/or the electronic connection system can be positioned within, or adjacent to, the chassis. At least one cassette can include a face including one or more ports, and the cassette positioned such that the one or more ports are accessible to a user of the desk. At least one cassette can be removably and/or slidably mounted within the chassis. The desk can further include one or more locking devices, such that the one or more cassettes can be locked to prevent access to one or more electronic components included in the one or more cassettes.

The desk can include a desk connector configured to connect the desk to a second desk or bridge unit, and can include a recess in an edge of the desktop configured to mate with a projection from an edge of a second desk or bridge unit and/or a projection from a second edge of the desktop configured to mate with a recess in an edge of a second desk or bridge unit. The desk connector can be further configured to support a side of the second desk or bridge unit.

The chassis can further include one or more conduits for housing cables, and the power distribution system and the electronic connection system can include one or more cables located substantially within the chassis. The chassis can include a frame positioned adjacent to the bottom-face of the desktop, and connected to support means including two or more legs for supporting the desktop.

The power distribution system and electronic connection system can include one or more cables, and the desk can further include a cable connector positioned substantially beneath the desktop, and approximately adjacent a first edge of the desktop, and configured such that the one or more cables can connect to a second cable connector of an adjacent second desk or bridge unit.

In general, in another aspect, the invention features a desking system including two or more connected desks. Each desk includes a plurality of sides, a bottom-face, and a top face; a chassis positioned substantially beneath the desktop including one or more cassettes, wherein at least one cassette includes one or more electronic components; a power distribution system providing power to at least one cassette; and an electronic connection system providing an electronic connection from the one or more electronic components to an electronic component located in a second desk connected to the desk. The power distribution system and the electronic connection systems are positioned substantially beneath the desktop, extending approximately from a first side of the desktop to a second side of the desktop. The power distribution system is configured to provide power to at least one desk or bridge unit connected to the desk. Each desk further includes a desk connector configured to connect the desk to a second desk or bridge unit.

Embodiments of the invention can feature one or more of the following. The desk connector of each desk can be further configured to support a side of a second desk. The desk connector can include a recess in an edge of the desktop configured to mate with a projection from an edge of a second desk or bridge unit connected to the desk, and/or a projection from a second edge of the desktop configured to mate with a recess in an edge of a second desk or bridge unit connected to the desk.

The desking system can further include one or more bridge units, each bridge unit including a unit top including a plurality of sides, a bottom-face, and a top face; a desk connector configured to connect the bridge to a desk or second bridge unit; and a cabling system configured to house one or more cables received from a first desk or a second bridge unit connected to a first side of the bridge unit and extending to a second desk or a third bridge unit connected to a second side of the bridge unit. At least one bridge unit can be connected to a desk on a first side of the bridge unit and is primarily supported on the first side by the desk.

At least one cassette included in a desk in the desking system, can include a face including one or more ports and the cassette can be positioned such that the one or more ports are accessible to a user of the desk. At least one cassette included in a desk can be removably and/or slidably mounted within the chassis. The power distribution system and electronic connection system of each of the one or more desks can include one or more cables, and each desk can further include cable connecting means positioned substantially beneath the desktop and approximately adjacent a first edge of the desktop and configured such that the one or more cables can connect to a second cable connecting means of an adjacent second desk or bridge unit.

Each desk can further include at least one opening located in each of at least two sides of the chassis, the opening including a flexible cushioner, such that one or more cables extend through the opening into a corresponding opening of a second desk connected to the desk. The flexible cushioner contacts and is compressible against a second flexible cushioner included in the corresponding opening of the second desk. The desking system can further include one or more end pieces, where an end piece is configured to connect to a desktop connector of a desk or bridge unit and includes at least one substantially straight edge. The invention can be implemented to realize one or more of the following advantages. The desking system eases installation, since the system uses desk and bridge units that can be prefabricated, and require little or no modification on site to install the system. The desk and bridge units can connect together, and power cables can clip together, to provide a "plug-and-play" desking system. The desking system reduces the likelihood of electronic components included in the desks being damaged or stolen, because the components are located in a secure area and can be locked to or within the desking system, for example, by encasement within a lockable cassette. The lockable cassette can be non-standard, making casual theft less likely. Accidental abuse of the desks and electronic components is reduced through the robust design of the desk components, and by encasing cable and computer components within the desk's chassis.

The desk provides flexible usage, either as computer desk or as an ordinary desktop generally cleared of computer components. The desk system provides the opportunity to provide desk, computer, VDU, and cabling more cost effectively, because the production processes involved in the manufacture of the desk components can also provide the infrastructure for the other components, such as a case for the computer components, a cable-way for the power, direct connections for both power and networking cables, and a combined power supply unit for both computer and a VDU.

The details of one or more embodiments of the invention are set forth in the accompanying drawings and the description below. Other features and advantages of the invention will become apparent from the description, the drawings, and the claims.

DETAILED DESCRIPTION

Figure 1:
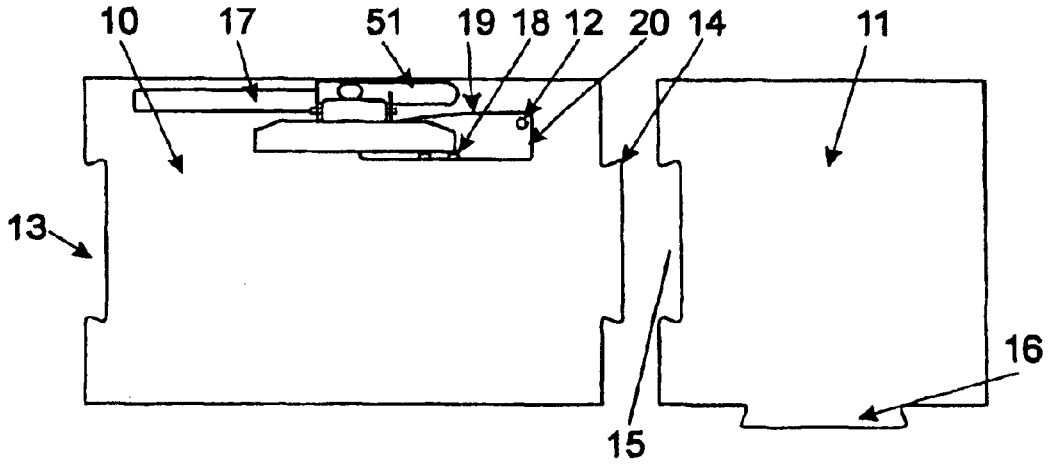
FIG. 1 is a top view of a desk.

In FIG. 1 there is shown a part of a desk system including a desk 10. The desk 10 can be connected to a similar desk, which can be the same or have a different plan shape to the desk 10 shown in FIG. 1. The desk 10 includes a connecting recess 13 at one side and a complementary retaining tooth 14 at the other side, so that two similar desks can when abutting interlock with each other. Also shown in FIG. 1 is a bridge unit 11 having a retaining tooth 16 and complementary connecting recess 15. As shown, the teeth 14, 16 and recesses 13, 15 can be on opposite sides of the desk/bridge unit, or on adjacent sides.

The desktop work surface, and/or one or more sides of the desktop and/or chassis can include one or more recesses for receiving a keyboard, a mouse, and/or a VDU or VDU mount. The desktop work surface can also include one or more holes, to permit access to items under the desktop. One or more holes in the desktop can be provided to permit access to connection ports of the cassette 37 located underneath, for example USB, Ethernet, power telephone and other ports. The desktop can include one or more cover means, used to cover the recess(es) when the keyboard, a mouse, a VDU and or other peripheral devices are not being placed in or taken out of the recess(es). One or more of the cover means can also be provided for the one or more access holes, and can include locking means to prevent access to unauthorized personnel.

Figure 2:
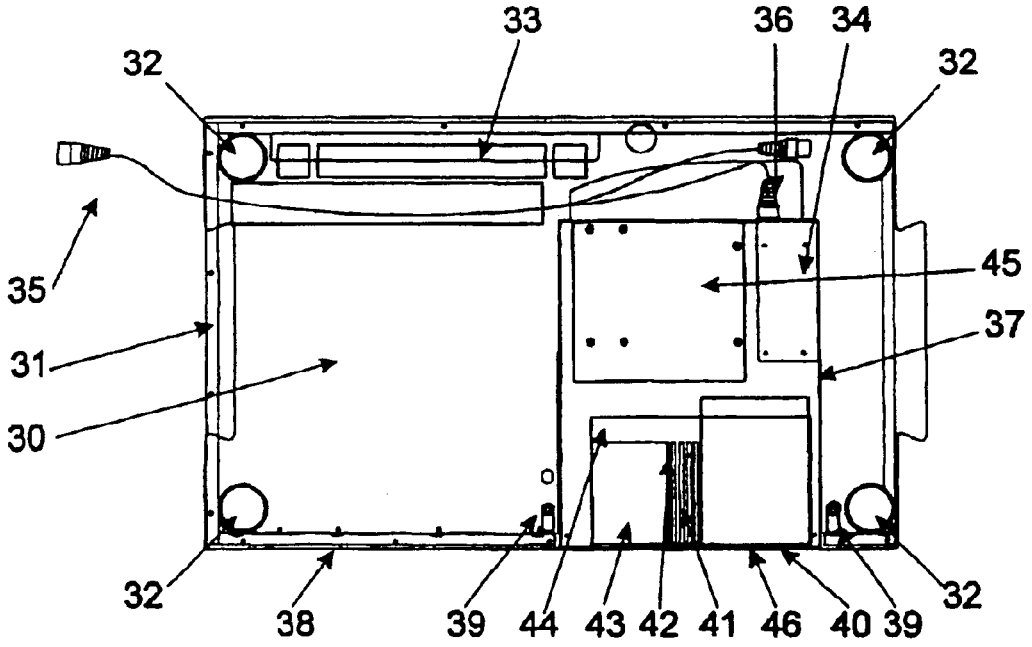
FIG. 2 is a top view of the desk of FIG. 1 with the desktop removed.

FIG. 2 shows the desk 10 with the desktop removed. In one embodiment, in a stand-alone situation, a chassis 30 includes a frame 31 in the form of metal tubing forming a rectangular frame. Four threaded mounting sockets 32 are cut into the frame 31 at the corners to accommodate the legs 50, and a chassis 30 to which the mounting sockets 32 are attached. The legs 50 can be threaded and are screwed into the mounting sockets 32. If two or more desks are positioned adjacent to each other, then only one desk requires four legs and the remaining linked desks each only need two legs. For each remaining linked desk, the end without legs can be supported on frame 31 of the adjacent desk, which is part of the chassis 30, exposed by the cut-out 13 or the recessed sections of each retaining tooth. Alternatively, each alternate desk/bridge unit can have 4 legs with each desk/bridge unit in-between resting on the adjacent desk/bridge unit.

The desk 10 can include one or more cassettes 37, including or housing one or more electronic components. At least one face of a cassette 37 can be located adjacent to the desktop side at which a person works at the desk, such that the cassette, or one or more ports in the cassette, are accessible to that person. The cassette 37 can form part of the chassis 30. The cassette can be located entirely under the desktop, and can be removably mounted to the desktop. In one embodiment, the cassette is releasably mounted to the desktop by any suitable means, for example, slidably mounted. The underside of the desktop can be recessed to accommodate part or the entire cassette, and components contained therein. Preferably the work surface extends over the top of at least most of the cassette and components contained therein, so that the inside of the cassette cannot be accessed from above the desk, and preferably the majority of the cassette is not visible from above the desktop.

The cassette can be a self-contained unit that encloses the electronics components, or at least one face can be open to allow easy access when it is removed from the desk. In one embodiment the cassette contains computer components, communications components and/or other electronics equipment. In another embodiment the cassette is (or includes) a docking station, to which a laptop, notebook or other portable computer or electronics device can be temporarily connected. In certain situations, for example hot-desking or transfer from office to home use, it may be preferred to provide cassettes that can be removed by the users for transport and insertion into another desk or reinsertion into the same desk at a later time.

Suitable electronics components that can be included in the cassette include a central processing unit (CPU), modem, a disc drive unit, a floppy disc drive, a Zip drive and a CD disk drive. Other computer components can be included, subject to space limitations within the cassette. Without the presence of any disc drives, the cassette can provide the basis for a thin client system, where the primary processing and media storage is carried out on a central server, which is networked to the cassettes. The cassette can be made of any suitable material, for example, metal sheet or plastic.

As shown in FIG. 2, the chassis 30 can have an open section at a front edge, which can accommodate a computer cassette 37 that can contain a CPU 45. The cassette can include a disc drive unit 43, a floppy disc drive, a Zip drive, a CD disk drive and other computer components. Functions requiring user access, such as the floppy and CD disk drives, the power-on switch, USB ports, headset connection ports and the like, can be located at the front of the cassette 37 adjacent the desk side at which a user works. Other functions, such as serial, parallel, and additional USB ports, and speaker and perhaps headphone connectors, can be located at the back of the cassette 37, and can be accessed via a hole covered by a hatch 19. For security purposes, the power-on switch can be located at the back of the cassette and accessible only through the hatch 19. The cassette is lockable against the chassis using a key mechanism 39 once the cassette has been fully inserted into the chassis.

The chassis 30 can be any suitable chassis, and can be integral with, or attached to, support means. The chassis 30 includes one or more cassettes, and in one embodiment includes the frame 31. The chassis 30 can also include cable conduits through which cables can pass, and which protects the cables. The cable conduits can be tubes, trays or other suitable means and are located beneath the desktop. One or more cable conduit can create an air channel that assists in ventilating and cooling at least some of the electronic components included in the cassettes. The chassis 30 is also capable of accommodating technologies other than personal computing, particularly where such technologies need to be networked. The chassis 30 can be made of any suitable material or combination of materials, for example, metal tubing or U shaped sections.

The front of the cassette 37 can be painted or finished with a powder coated metal fascia 40, or by any other suitable means, and the front of the chassis 30 can be finished with a similar fascia 38. The cassette fascia 40 can include cutouts to provide access to the various drives, switches and LEDs of electronic components included therein. Further, a security cover plate 46 can be located in front of the cassette fascia, and in one embodiment can be pivoted so that the cover plate 46 can be lowered into a position below the cassette. In a raised position, the cover plate can be locked into position using the same locking mechanism as for the cassette 39. The cover plate 46 can have the same finish as the fascias 38 and 40, and sit flush with the chassis fascia 38 when in the raised position.

The fabrication and servicing of the cassette 37 is made easier by mounting the various drives in a metal cradle 44, which can then be located into the cassette 37 as a single unit, using a minimum number of fixings. In one embodiment, the drives can be held in place within the cradle 44 by raised nodules punched into the two sides of the cradle 44, which then locate into holes at the side of the drives, and/or by inserting a U shaped channel 42 in between the drives, again with the appropriate nodules on the sides. The center strip 41 of the channel can be made from sprung steel to allow the sides of the channel to be squeezed together to allow the drives to be inserted. If drives are only required on one side of the cradle, the other side can have a dummy section inserted in order to maintain tension in the center channel.

The support means can be any suitable support means, and can be additional to, or an integral part, of the chassis 30. The support means can include one or more legs 50, which can be integral with, permanently attached, or detachable from, the chassis 30. The legs 50 can attach by any suitable means, for example, the legs 50 can screw into sockets located within the chassis 30. Alternately, the support means can include one or more brackets affixed to one, or more walls or other features of a building in which the desk is to be used. A wall-mounted desk can be foldable against the wall to enable use of the floor space.

When two or more desks, or a desk and bridge unit, are connected, then only one of the desks or bridge units can require at least one leg at opposing sides, the remaining connected desks/bridge units can have at least one leg on one side only, with the side without legs being supported on the side of the desk/bridge unit against which the desk/bridge unit abuts.

The support means can be made of any suitable material or combination of materials, for example, metal tubing. The support means can include transport means that enable the desk 10 to be moved from place to place. The desk connections and transport means permit the desk to be easily disconnected from a desk, transported to a new location and connected to another desk.

The desk shown in FIGS. 1 and 2, in one embodiment can operate on 240V, for example, and use a system of standard IEC power cables 36 linked together and located beneath the desktop. Each cable includes a male plug at the left hand end and a female plug at the right hand end. These plugs connect to the cables of adjoining desks, thus creating a continuous power circuit supplying adjoining desks. The IEC power cables can be accommodated within a segregated metal cable channel within the chassis, running between the left-hand edge of the chassis 30 and the beginning of the cassette 37; this ensures easy installation of the cables and protects them from unauthorized access.

The cable can be split at a suitable point along its length to provide a third section that has a female plug on its end. This connects to a power input connector on the back of the power supply unit 34 within the cassette. The use of a splitter cable allows one cassette unit to be taken out of the power circuit without other units losing power.

The power supply unit 34 in the cassette 37 provides suitable DC power supplies for the computer components and the VDU. The power supply unit 34 can be mains powered and is supplied power via the power cables 36. Where a TFT (thin film transistor) unit is used, the power supply unit 34 can also provide power to the VDU using a spare power channel from the power supply unit 34. If a CRT (cathode ray tube) unit is used, then a standard voltage power supply can be used, and is supplied either by an alternative splitter lead that provides an additional link, or from an additional power connection at the rear of the power supply unit 34.

Where a low voltage power supply is used (i.e., any power supply of 100 V or less), a transformer unit 35 (FIG. 2) is used to supply power to the system. Instead of the IEC splitter cable, three alternative cables/bus bars (i.e., live, neutral, and earth) can be used, with an appropriate specification for the voltage used. Each cable or bus bar meets at a three way connector located in the chassis 30, and positioned behind the cassette 37, to facilitate a connection to the power supply unit 34 within the cassette 37.

The power distribution system can include split power cabling. The cabling can provide a connection between one side of the desktop and another side, and also to the one or more cassettes. The power can be a low voltage system that provides power to the electronic units directly; the low voltage can be provided by a mains powered transformer unit coupled to one end of a sequence of power distribution systems, in a sequence of two or more desks. Alternatively, the power can be a mains type system (AC, and 100 V or 230 V), in which case a cassette can include (or be) a power unit. Any suitable power cable may be used, for example, when using a standard power supply in the UK, 240 V, adjacent desks and the pme or more cassettes can be linked using one or more standard IEC power cables linked together.

The cables can be located beneath the desktop. The cables can terminate adjacent a side of the desk in cable connecting means, which enables the cables to be connected to the cables of another desk. In one embodiment the cable connection means comprises one or more plugs. In one embodiment, a cable or group of cables ends at a male plug at one side of the desk and a female plug at the other side of the desk. The connection means enable easy connection of the cables of adjoining desks, thus creating a continuous power circuit supplying adjoining desks.

In another embodiment, the power distribution source includes a cable extending from one side of the desktop to a power connector unit connected to the chassis. The cable is sufficiently long, such that the cable can be inserted through a hole in the chassis side of an adjacent desk, and connected to a connector unit of the adjacent desk.

The cabling is located in the desk in protective conduits connected to the desk. The conduits and/or trays can be part of the chassis. In one embodiment, the chassis includes a segregated metal cable channel running between adjacent one side of the desk the cassette(s) and another side of the desk, thus easing installation of the cables, and protecting them from unauthorized access and damage.

The cable can be split at one or more suitable points along its length, to provide a section that also has a connector on an end to connect to a power input connector on the back of a power supply unit of the cassette(s). The use of a splitter cable allows one or more cassette units to be taken out of the power circuit, without other units losing power.

A power supply unit can be incorporated in the chassis or support means, as part of a power distribution system of the desk. Alternatively, a power supply unit can be located within the cassette, or such that the cassette can be connected to it. The power supply unit provides suitable DC power supplies for the computer components and VDU. Any suitable convenient values can be used, including +11 V., +5V, +2.3 V, 0 V., −2.3 V, −5 V, and C11 V. The power supply unit can be mains powered and supplied via the power cables. The power distribution system also can supply power to the VDU, and one or more cables can be split to connect to the one or more VDUs. If a CRT (cathode ray tube) unit is used, then a standard voltage power supply is likely to be used, and can be supplied either by an alternative splitter lead that provides an additional link, or from an additional power connection.

Where a low voltage power supply is used (i.e., any power supply of 100 V or less), a transformer unit can supply power to the system. The transformer unit can be positioned on the wall (or any other convenient place) between a mains power socket and the first desk. The power supply unit should be a transformer of a suitable rating, to allow transforming the incoming low voltage power to the appropriate voltages for the electronics and display components. Instead of the IEC splitter cable, at least three alternative cables/bus bars (i.e., live, neutral, and earth) can be used, with an appropriate specification for the voltage used. Each cable or bus bar meets at a connector to the cassette, to facilitate a connection to the power supply unit for the cassette.

In cases where the electronics are networked, there can be included network cabling. There can also be included one or communications systems, for example Internet, Intranet, access to one or more databases, audio and video systems, fax and other known systems. Cabling connecting the electronics system, and any separate communication system, can include split cabling, or can link certain components in series, or as otherwise required. The cabling provides a connection from adjacent one side of the desktop to adjacent another side of the desktop and also to one or more of the cassettes and possibly also to one or more peripheral devices. Where possible, the cabling is located within the desk, most of the cabling being located in protective conduits and/or trays connected to the desk: the conduits and/or trays can form part of the chassis.

The communications and/or connections system can include one or more cables and/or UV, infrared, wireless or other systems for enabling electronics devices or units in one part of the desking system, to communicate with electronics devices or units attached to the same desk, or located in another part of the desking system. Network and communications cables can end adjacent each side of the desk that is to be connected to another desk with cable connecting means.

In one embodiment, the electronics and/or communications distribution system include a cable extending from one side of the desktop to an electronics/communications connector unit connected to the chassis. The cable is sufficiently long, such that the cable can be inserted through a hole in the chassis side of an adjacent desk and connected to a connector unit of the adjacent desk.

Where UV, infrared, wireless and like links are used, there can be included repeater, transponder or other means to facilitate linking of the devices. Infra-red or wireless coupling can be included in the computers, so that such network cabling is unnecessary. If additional cable channels for power and network cables are desired, additional cable channels can be located in or adjacent the chassis, either fixed to the chassis or fixed to a wall or similar building component.

The location of the cables makes it possible to arrange a series of desks in such a way that there is a continuous route for cables. Rubber grommets can be provided at the openings at the sides of the desk where the cables exit, and at ends of cableways in the desks to protect the cables. Grommets can be positioned, such that when two desks are positioned side by side against each other, two facing grommets compress against each other, and therefore protect the cables where they cross the gap between the desks. It will be appreciated however, that spur and/or ring power cable arrangements are possible using various openings for cable entry routes. In another embodiment, cable plugs can be positioned on each desk, such that when two desks are positioned side by side against each other, and connected together, two plugs connect together. Cabling from power points, and electronic and communications cabling for the desking system, can be located in one or more legs of one or more desks, so as to protect the cabling.

Figure 4:
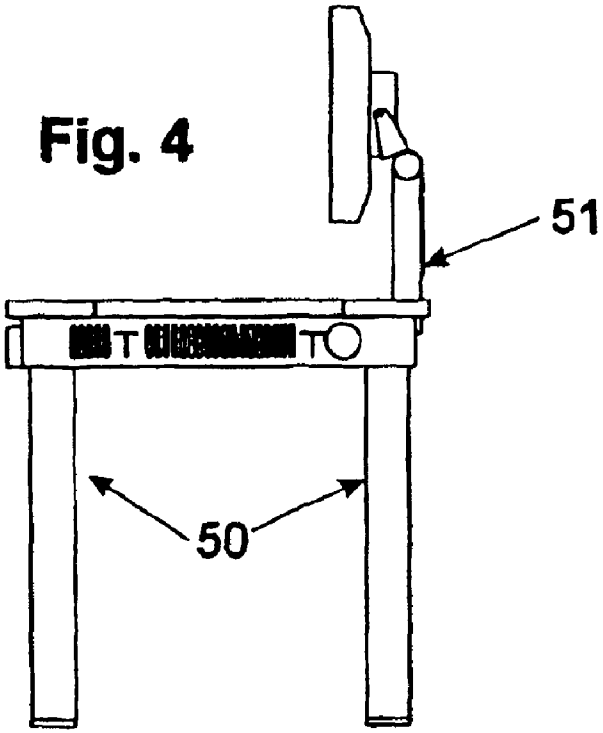
FIG. 4 is a side view of the desk of FIG. 3.
Figure 3:
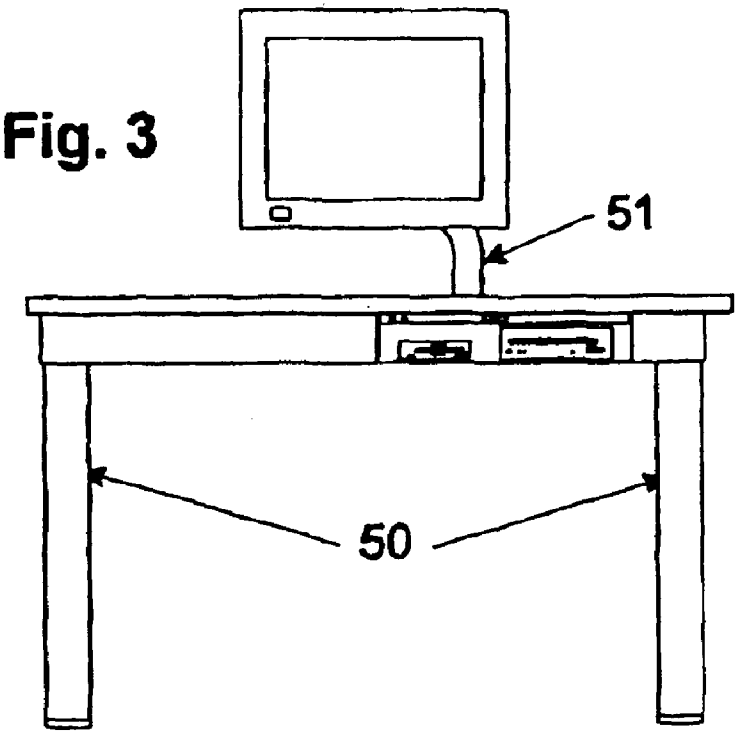
FIG. 3 is a front view of the desk of FIG. 1.

The computer and electronic components included in the desk can include, for example, a computer, Internet communicator, a CPU, a disk drive unit, a mouse, a keyboard, and a VDU. Referring to FIGS. 3 and 4, the VDU, where it is of a TFT or other flat screen type, can be located on a VDU mount means, which preferably takes up minimal desk space and minimally restricts a user's view from behind the desk.

In one embodiment, the VDU mount means can include a single arm 51 rotatably connected to the desk. The arm 51 can be flexible or stiff, and can be hollow with any signal and power cables for the VDU located within the arm to protect them. The VDU can be mounted adjacent an end of a tube remote from the desktop, and can be connected to the remote end of the VDU mount with a universal or swivel joint, which permits positioning of the VDU by the user.

Preferably the VDU mount is mounted on the desk towards the center at the rear, thus providing clearance from the desktop and allowing appropriate movement of the VDU by the user. Various models for the VDU mount means are suitable, giving varying degrees of flexibility in the movement of the monitor. A suitably robust transparent protective screen can be mounted in front of the VDU if desired. Where the VDU is of a CRT type, this can be positioned on the desktop. Preferably, the desktop for CRT VDU usage should be some 200 mm deeper than where a TFT VDU is used, giving desktop depths of approximately 800 mm and 600 mm respectively.

As an alternative to the VDU bracket referred to above, the VDU can be stowably mounted. For example, the VDU can be mounted on a gas strut combined with a guide, such that when pressure is applied to the top of the VDU, the unit sinks down on the gas strut to below the desktop, where the unit can be locked into position. Alternatively, or in conjunction with a gas strut, the VDU can move along a guide rail, for example into a vertical position at the back of the chassis, or horizontal position within the chassis. In order to accommodate this action, a hatch in the desktop can open and close, for example, by applying pressure to the hatch when it is in a closed position, whereupon a pressure catch releases the hatch and a spring mechanism opens the hatch to a fully opened position, thus allowing the VDU to be stowed away and the hatch to be closed. When the VDU needs to be revealed, then reversing the above action will open the hatch, and allow the VDU to rise into an operational position and the hatch to close again.

A signal cable for a mouse can run across the desktop and enter the desktop via an access recess 19 (FIG. 1), to one corner of the desktop and into a connector at the back of the cassette 37. The access recess 19 consists of a roughly oval hole in the desktop with a fitting cover 20 having a suitable number of cutouts 18. One side of cover 20 rests on a rim inside recess 19; the other end has a tongue that is first introduced into a slot in the edge of the desktop within the access recess. Pressing the cover 20 (where the rim is not present) will therefore cause the cover 20 to tilt, so that the cover 20 can be temporarily removed to provide access to the rear of the chassis 30, behind the cassette 37. The cover 20 is locked to the desktop using a key-operated catch 12. Not only does the access hatch provide access to cable connections at the rear of the cassette 37, but the hatch also provides a space to stow the mouse if desirable.

The desktop further includes a slot 17 for storing the keyboard when it is desired to clear a larger space on the desktop. The signal cable to the keyboard can pass through the slot 17, facilitating stowage of the keyboard.

Network cabling is included in cable channel 33 for networking the computer to a central server. Telephone cabling is also provided, and a modem can be included in the cassette 37, or a modem can be connected to chassis 30, or on the desktop.

Each desk and bridge unit can include connecting means to interlock one desk to another desk or bridge unit. The connecting means can hold the desks/bridge units securely together when connected to each other, but allow easy disassembling when they are required to be moved. In one embodiment, the connecting means include at least one connecting recess located in one desktop/bridge-top and/or chassis, and one or more retaining teeth of a complementary shape to the connecting recess in the opposing location of the adjacent side of the desktop/bridge-top and/or chassis. The connecting means thereby include a jigsaw-like interlocking holding recess and tooth.

The retaining tooth of one desk/bridge unit, when placed in the retaining recess of the abutting desk/bridge unit, can rest on the latter desk/bridge unit, thus removing the need for separate support means on at least one side of at least one desk/bridge unit. For example, the retaining tooth can rest on a part of the chassis exposed by the holding recess. Fixing means may also be used in conjunction with the recess and teeth. It will be appreciated that various other shapes of connecting means may be used. Any suitable connecting means can be used, for example, bolts or screws connecting desktops and/or chassis of desks or bridge units adjacent each other. End caps can also be provided, which on one side are complementary in shape to the retaining teeth or locking recess, and can be used on a free end of the desk (i.e., an end that is not connected to another desk or bridge unit) to provide a straight end for the desk.

Figure 5:
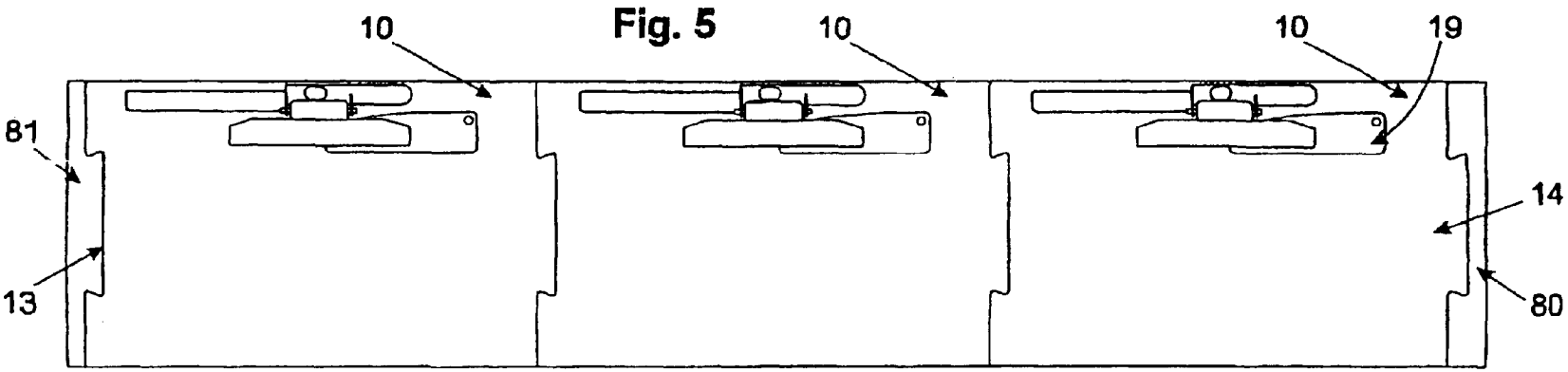
FIG. 5 is a top view of a series of desks of the type shown in FIG. 1.
Figure 6:
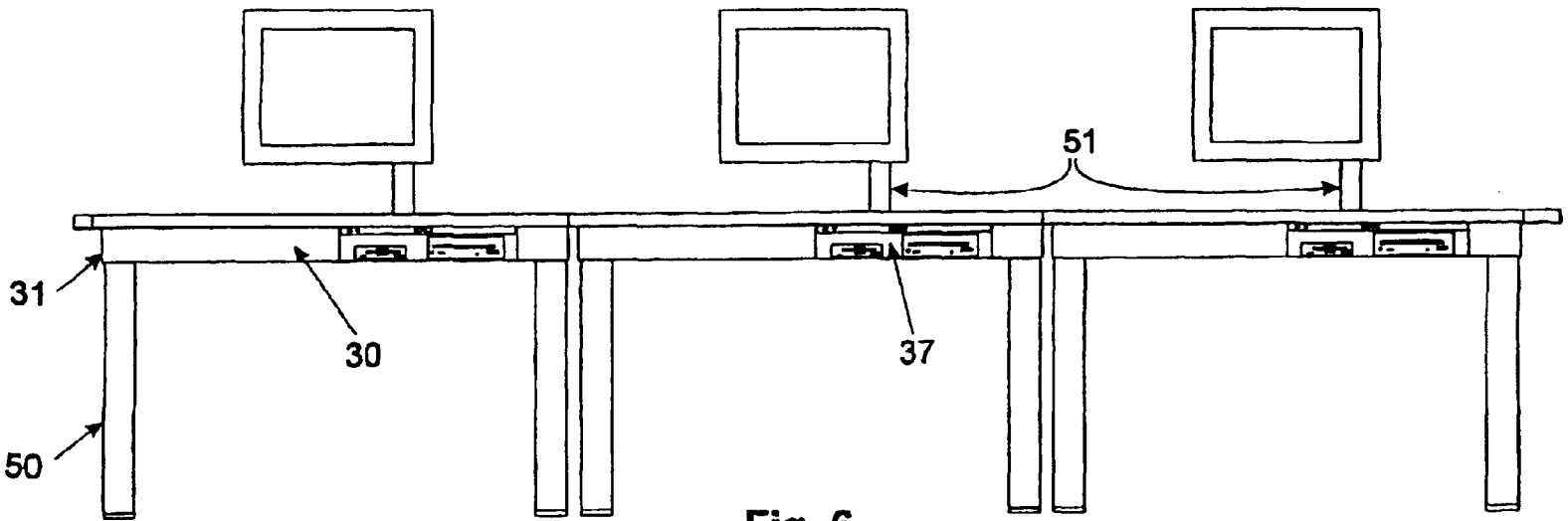
FIG. 6 is a front view of series of desks of the type shown in FIG. 1.

In FIGS. 5 and 6 there are shown three desks 10 of the type shown in FIG. 1, with the connection recesses 13 and retaining teeth 14 interconnected to connect the desks. Ends 80 and 81 have been connected to cover the free connection recess 13 and retaining tooth 14, to thereby provide straight sides at the free ends of the series of desks.

Figure 7:
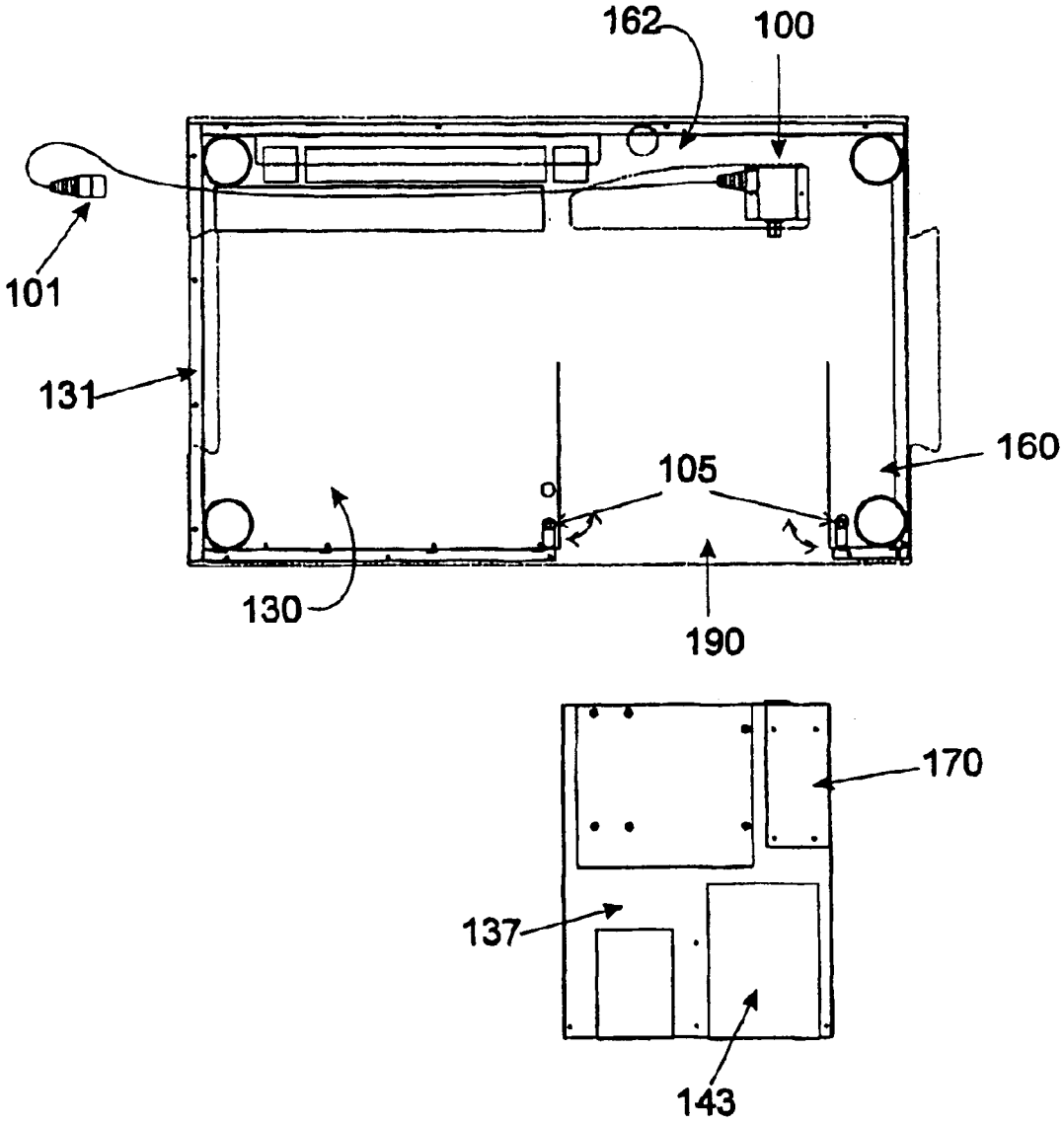
FIG. 7 is a top view of a desk showing an alternate power distribution system, with the desktop removed Like reference numbers and designations in the various drawings indicate like elements.

FIG. 7 shows a power cable 101 connected to a power unit 100: a second cable connecting a second desk to power connector 100 is not shown. Trays 160 and 162 are located under the desktop, one adjacent each of two sides of the desk. One or both of the trays create an air channel that assists in ventilating and cooling at least some of the electronic components. Cassette 137 slidably inserts into opening 190 in frame 131 of chassis 130. Locks 105 may temporarily lock cassette 137 in place.

A bridge unit can be provided that can be used to connect two or more of the desks together. A bridge unit can include: a bridge-top having a top-face, bottom-face, and sides; a chassis; and a power distribution system mounted beneath the top and within the chassis from one side of the bridge-top to another, connectable to adjacent desks and/or bridge units at one or more sides. The bridge unit can be mounted on its own support means, and can include a power connector box and/or an electronic connector box. One or more of the desks to which a bridge unit is connected can support the bridge unit in place. The bridge unit can include a cassette including one or more electronics systems releasably connected underneath the bridge-top face. The bridge units can be linear in shape, similar to a desk but without a cassette, or be angular units that enable desks to be connected in the system in different configurations. The bridge units are in effect dummy units that can be included in the system to allow the spacing of the desk units to be increased, and/or the line of desk units to include turns.

Means can be provided for screwing or bolting the units together, in addition to the interlocking by teeth and recesses. The desks will typically be rectangular (possibly of different widths), and the bridge units will typically be square; however, they can be of any convenient shape, depending on the preferred layout to be achieved. The desks and bridge units can be made of any suitable combination of materials, for example, metal, wood and/or medium density fiberboard (MDF).

The invention has been described in terms of particular embodiments. Other embodiments are within the scope of the following claims. For example, desks and bridge units can have variable height legs, and/or fold back against the wall to provide flexible use of space. Where desktops form the end of a run of desks, the free end of a desk can be manufactured without a cut-out or projection in order to provide a neat end profile. The cassette is also capable of being accommodated within other pieces of furniture, with the concept for their accommodation and operation remaining the same.

What is claimed is:

1. A desk adapted for connection to a second desk as part of a network of desks, the desk comprising:

a desktop comprising a plurality of sides, a bottom-face, and a top face;

a chassis positioned substantially beneath the desktop comprising one or more cassettes, wherein at least one cassette includes one or more electronic components;

a power distribution system providing power to at least one cassette, the power distribution system being positioned substantially beneath the desktop, extending approximately from a first side of the desktop to a second side of the desktop, and configured to provide power to at least one adjacent desk or bridge unit; and an electronic connection system providing an electronic connection from the one or more electronic components to an electronic component located in a second desk, the electronic connection system being positioned substantially beneath the desktop and extending approximately from a first side of the desktop to a second side of the desktop.

2. The desk of claim 1, wherein the power distribution system is positioned within the chassis.

3. The desk of claim 1, wherein the power distribution system is positioned adjacent to the chassis.

4. The desk of claim 1, wherein the electronic connection system is positioned within the chassis.

5. The desk of claim 1, wherein the electronic connection system is positioned adjacent to the chassis.

6. The desk of claim 1, wherein at least one cassette includes a face including one or more ports and the cassette is positioned such that the one or more ports are accessible to a user of the desk.

7. The desk of claim 1, wherein at least one cassette is removably mounted within the chassis.

8. The desk of claim 1, wherein at least one cassette is slidably mounted within the chassis.

9. The desk of claim 1, further comprising:

one or more locking devices, such that the one or more cassettes can be locked to prevent access to one or more electronic components included in the one or more cassettes.

10. The desk of claim 1, further comprising:

a desk connector configured to connect the desk to a second desk or bridge unit.

11. The desk of claim 10, wherein the desk connector is further configured to support a side of the second desk or bridge unit.

12. The desk of claim 10, wherein the desk connector includes a recess in an edge of the desktop configured to mate with a projection from an edge of a second desk or bridge unit.

13. The desk of claim 12, wherein the desk connector further includes a projection from a second edge of the desktop configured to mate with a recess in an edge of a second desk or bridge unit.

14. The desk of claim 1, wherein:

the chassis further comprises one or more conduits for housing cables; and the power distribution system and the electronic connection system include one or more cables located substantially within the chassis.

15. The desk of claim 1, wherein the power distribution system and electronic connection system include one or more cables, the desk further comprising:

a cable connector positioned substantially beneath the desktop and approximately adjacent a first edge of the desktop and configured such that the one or more cables can connect to a second cable connector of an adjacent second desk or bridge unit.

16. The desk of claim 1, wherein the chassis further comprises a frame positioned adjacent to the bottom-face of the desk, the desk further comprising:

support means including at least two legs connected to the frame and supporting the desktop.

17. A desking system, comprising:

two or more connected desks, each desk comprising:

a desktop comprising a plurality of sides, a bottom-face, and a top face;

a chassis positioned substantially beneath the desktop comprising one or more cassettes, wherein at least one cassette includes one or more electronic components;

a power distribution system providing power to at least one cassette, the power distribution system being positioned substantially beneath the desktop, extending approximately from a first side of the desktop to a second side of the desktop, and configured to provide power to at least one desk or bridge unit connected to the desk;

an electronic connection system providing an electronic connection from the one or more electronic components to an electronic component located in a second desk connected to the desk, the electronic connection system being positioned substantially beneath the desktop and extending approximately from a first side of the desktop to a second side of the desktop; and a desk connector configured to connect the desk to a second desk or bridge unit.

18. The desking system of claim 17, wherein the desk connector is further configured to support a side of the second desk.

19. The desking system of claim 17, wherein the desk connector includes:

a recess in an edge of the desktop configured to mate with a projection from an edge of a second desk or bridge unit connected to the desk;

a projection from a second edge of the desktop configured to mate with a recess in an edge of a second desk or bridge unit connected to the desk.

20. The desking system of claim 17, further comprising:

one or more bridge units, a bridge unit comprising:

a unit top comprising a plurality of sides, a bottom-face, and a top face;

a desk connector configured to connect the bridge to a desk or second bridge unit; and a cabling system configured to house one or more cables received from a first desk or a second bridge unit connected to a first side of the bridge unit and extending to a second desk or a third bridge unit connected to a second side of the bridge unit.

21. The desking system of claim 20, wherein at least one bridge unit is connected to a desk on a first side of the bridge unit and is primarily supported on the first side by the desk.

22. The desking system of claim 17, wherein at least one cassette included in a desk includes a face including one or more ports and the cassette is positioned such that the one or more ports are accessible to a user of the desk.

23. The desking system of claim 22, wherein at least one cassette included in a desk is removably mounted within the chassis.

24. The desking system of claim 22, wherein at least one cassette included in a desk is slidably mounted within the chassis.

25. The desking system of claim 17, wherein the power distribution system and electronic connection system of each of the one or more desks include one or more cables, each desk further comprising:

cable connecting means positioned substantially beneath the desktop and approximately adjacent a first edge of the desktop and configured such that the one or more cables can connect to a second cable connecting means of an adjacent second desk or bridge unit.

26. The desking system of claim 17, wherein each of the one or more desks further comprise:

at least one opening located in each of at least two sides of the chassis, the opening including a flexible cushioner, such that one or more cables extend through the opening into a corresponding opening of a second desk connected to the desk and such that the flexible cushioner contacts and is compressible against a second flexible cushioner included in the corresponding opening of the second desk.

27. The desking system of claim 17, further comprising:

one or more end pieces, where an end piece is configured to connect to a desktop connector of a desk or bridge unit and includes at least one substantially straight edge.

28. A desk adapted for connection to a second desk as part of a network of desks, the desk comprising:

a desktop comprising a plurality of sides, a bottom-face, and a top face;

a chassis positioned substantially beneath the desktop comprising a cassette for accommodating a computer, said cassette extending into the chassis from a front edge of the chassis but not as far as a back edge thereof to thereby define a channel between a back face of the cassette and the back edge of the chassis; and cabling associated with the cassette being accommodated in the channel and arranged to extend from a first side of the desktop to a second side of the desktop, and configured to connect to at least one adjacent desk or bridge unit.

29. The desk of claim 28, wherein the cabling comprises at least one of power distribution cabling and computer network cabling.

30. A system for use beneath a desktop, comprising:

a chassis including:

one or more cassettes configured to receive one or more electronic components; and means for receiving a power distribution system providing power to at least one cassette;

a power distribution system positioned substantially beneath the desktop, extending approximately from a first side of the desktop to a second side of the desktop and configured to provide power to the chassis and at least one adjacent chassis included in an adjacent desk or bridge unit.

31. The system of claim 30, wherein the power distribution system is positioned within the chassis.

32. The system of claim 30, wherein the power distribution system is positioned adjacent to the chassis.

33. The system of claim 30, wherein at least one cassette is slideably mounted within the chassis.

34. The system of claim 30, wherein at least one cassette is adapted to slideably receive at least one of the one or more electronic components.

* * * * *